United States Patent [19]

Birkle et al.

[11] 4,435,265

[45] Mar. 6, 1984

[54] DEVICE FOR ELECTRO-DEPOSITION OF ALUMINUM

[75] Inventors: Siegfried Birkle, Hochstadt; Johann Gehring, Spardorf; Klaus Stöger, Nuremberg, all of Fed. Rep. of Germany

[73] Assignee: Siemens Aktiengesellschaft, Berlin & Munich, Fed. Rep. of Germany

[21] Appl. No.: 522,019

[22] Filed: Aug. 11, 1983

[30] Foreign Application Priority Data

Aug. 26, 1982 [DE] Fed. Rep. of Germany ..... 3231855

[51] Int. Cl.[3] ..... C25D 17/06; C25D 17/18; C25D 21/02

[52] U.S. Cl. ..... 204/198; 204/225; 204/274; 204/275

[58] Field of Search ..... 204/198, 199, 200, 202, 204/225, 226, 275, 274

[56] References Cited

U.S. PATENT DOCUMENTS

| | | | |
|---|---|---|---|
| 4,053,383 | 10/1977 | Dotzer | 204/225 |
| 4,176,034 | 11/1979 | Stoger | 204/199 |
| 4,265,726 | 5/1981 | Herrnring | 204/202 |
| 4,363,712 | 12/1982 | Birkle | 204/199 |
| 4,399,018 | 8/1983 | Birkle | 204/199 |

*Primary Examiner*—T. M. Tufariello

*Attorney, Agent, or Firm*—Hill, Van Santen, Steadman & Simpson

[57] ABSTRACT

In order to avoid smoke formation within the cover hood for the plating tank in an assembly for the electro-deposit of aluminum and contamination of charging and discharge liquid locks leading to and from the cover hood, a liquid spray chamber and a cooled condensing zone are disposed beneath a slotted cover plate leading to the interior space of the cover hood and the open ends of the individual electrolyte cell. The substrate goods and goods carriers are sprayed and cooled leaving the electro-deposit cells prior to being passed back into the interior space of the cover hood.

6 Claims, 3 Drawing Figures

1
2
3
4
5
6
7
8
9
10
11
12
13
14
15
16
17
18
19
20
21
22
23
24
25
26
27
28
29
30
31
32
33
34
42
43
110
141
200
II
II

DEVICE FOR ELECTRO-DEPOSITION OF ALUMINUM

BACKGROUND OF THE INVENTION

The invention concerns improvements in an assembly for the electro-deposit of aluminum onto base surfaces or substrate goods including a plating tank covered by a hood containing inert gas, such that smoke formation and the like arising from the plating cells of the tank are avoided.

A known device for electro-deposition of aluminum from aprotic, oxygen-free and water-free, aluminum-organic electrolyte, comprises an electroplating tank closed to ambient by means of a cover hood defining a space charged with inert gas. Substrate goods carriers are conveyed into the electroplating tank with the assistance of transport means over a charging liquid lock connected to the closing hood, passed by truck means into and out of the electroplating tank, and discharged with the assistance of further transport means over a discharge liquid lock likewise connected to the closing hood. The electroplating tank is subdivided into a plurality of identical individual cells rectangular in cross-section, which are disposed behind one another, such that the goods carriers are insertable and removable by a grip means allocated to all individual cells. The charging and discharging locks are disposed in series with the individual cells. A device of this type is described in detail in the German OS No. 31 33 162.

In this and similar systems, an electrolyte which consists essentially of aluminum triethyl, an aromatic hydrocarbon, and of an alkali fluoride is preferably employed. A majority of the aluminum triethyl becomes a free agent solid in the form of a complex. Such an electrolyte, however, reacts with water as well as with air, upon formation of solids. An electrolyte temperature of approximately 100° C. is employed in order to obtain as high as possible a deposition rate. This results in the fact that, due to the partial vapor pressures of the individual components of the electrolyte system, considerable amounts of solvent, and aluminum alkyl under certain conditions, pass into the closing hood space filled with inert gas. Larger amounts of solvent quickly evaporate from the electrolyte dampened goods carriers particularly when the goods carriers are removed from the electrolyte bath of the aluminum-plating cell so that even solid aluminum complex per se is entrained in a finely distributed form. A fine smoke thus arises as a result in the essentially oxygen-free and water-free inert gas space within the closing hood. This smoke also develops as a result of the reaction of the aluminum alkyl with the slight amounts of air and humidity present in the gas space. However, this smoke formation must be avoided in a plating system since it can have a negative effect on the adhesion and porosity of the aluminum coating.

A further problem also occurs in known devices of the above type. A fluid, usually a solvent, which usually has a lower vapor pressure at room temperature than the toluol in the approximately 100° C. hot aluminum-plating bath is situated as the sealing liquid in the fluid lock of the charging and discharging locks. Particularly in a large bath, solvent vapors and aluminum alkyl vapors cannot be prevented from proceeding into the fluid locks. This movement of vapors, however, must be prevented because of the danger of evaporation of the solvent out of the electrolyte and since irreversible chemical reactions in the liquid locks can lead to sludge formation in the lock due to precipitation of insoluble aluminum compounds. Thus, this vapor movement unchecked can lead to poor deposition quality.

One attempt to resolve the problems described above has been made by disposing cooling coils inside of the closing hood. The condensed aluminum electrolyte vapors are thereby subsequently returned into the electroplating bath. The transport of the electrolyte toluol and of the aluminum alkyl into the fluid locks can indeed be prevented with this measure but the smoke formation is not eliminated.

Further, due to non-governable temperature gradients between the sealing liquid and the electroplating bath on the one hand and the cooled space inside the closing hood on the other hand, a more or less considerable mass tramster of vapors naturally eventually occurs over a time span.

It is an object of the invention to improve the plating assembly of the type initially cited such that contamination of the liquid locks and of the gas space above the electrolyte with aluminum alkyl is reliably prevented and uncontrollable evaporation of larger amounts of solvent from the aluminum electrolyte is avoided.

SUMMARY OF THE INVENTION

In an assembly for the electrodeposit of aluminum onto substrate goods having a plating tank formed with a series of electrolyte cells and closed to ambient by a cover hood, there is provided a successively arranged liquid spray chamber and cooled condensing zone chamber above the vat of each individual cell and above that a slotted cover plate through which the goods carriers pass into and out of the cells. The condensing zone is preferably formed by a system of cooling coils. By virtue of this apparatus, the electrolyte, on the one hand, is rinsed off the goods carriers and, on the other hand, the solvent of the electrolyte and slight amounts of aluminum alkyl vapor are condensed so that a disruptive smoke formation in the gas space beneath the coverhood is eliminated.

The solvent condensate gained in the condensation can be employed for the spray. Otherwise, the spray agent can easily be gained from the electrolyte.

DESCRIPTION OF THE PREFERRED EMBODIMENT

Figure 1:
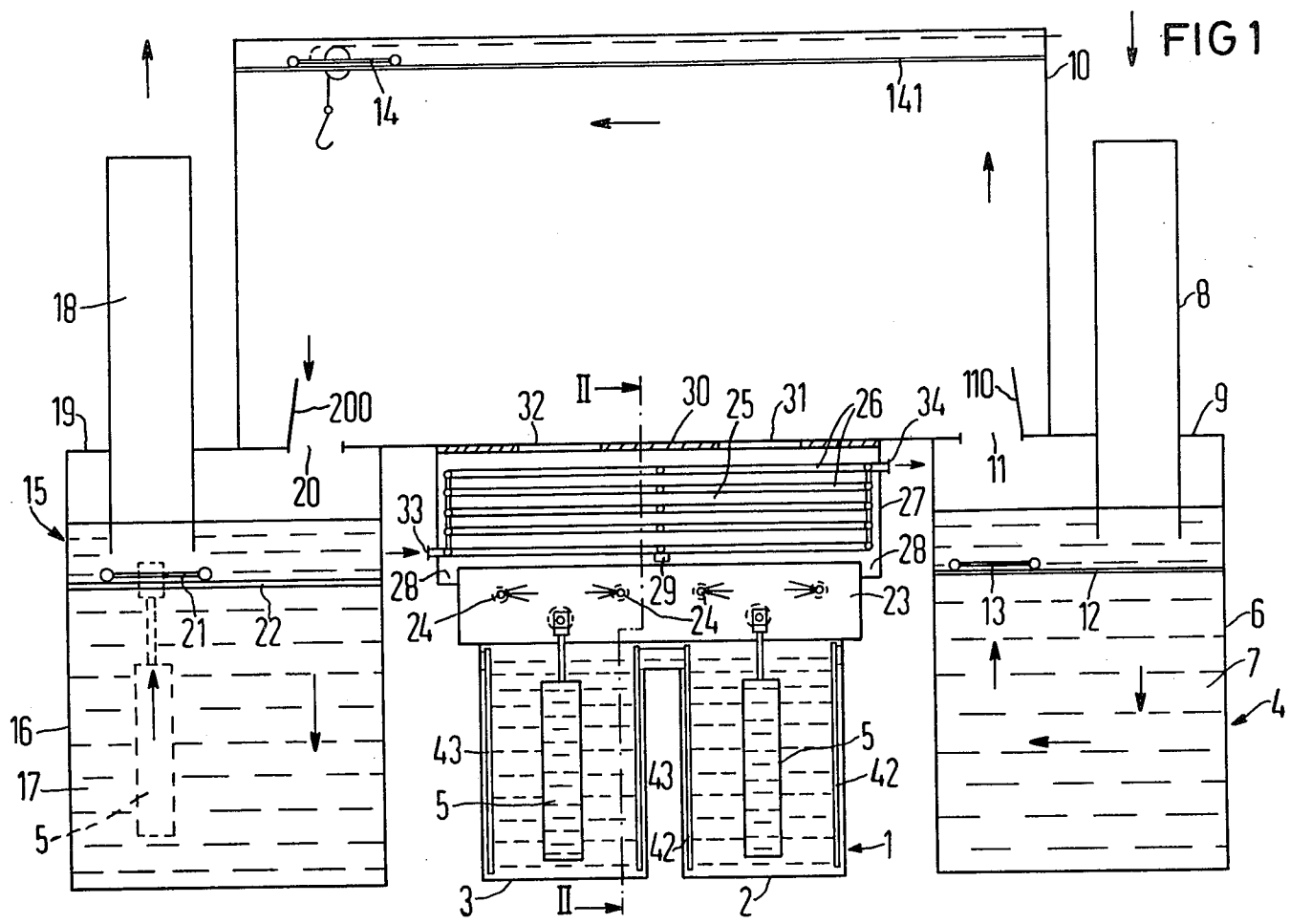
FIG. 1 is an overall cross-sectional view of a device for electro-deposition of aluminum, constructed in accordance with the invention.
Figure 2:
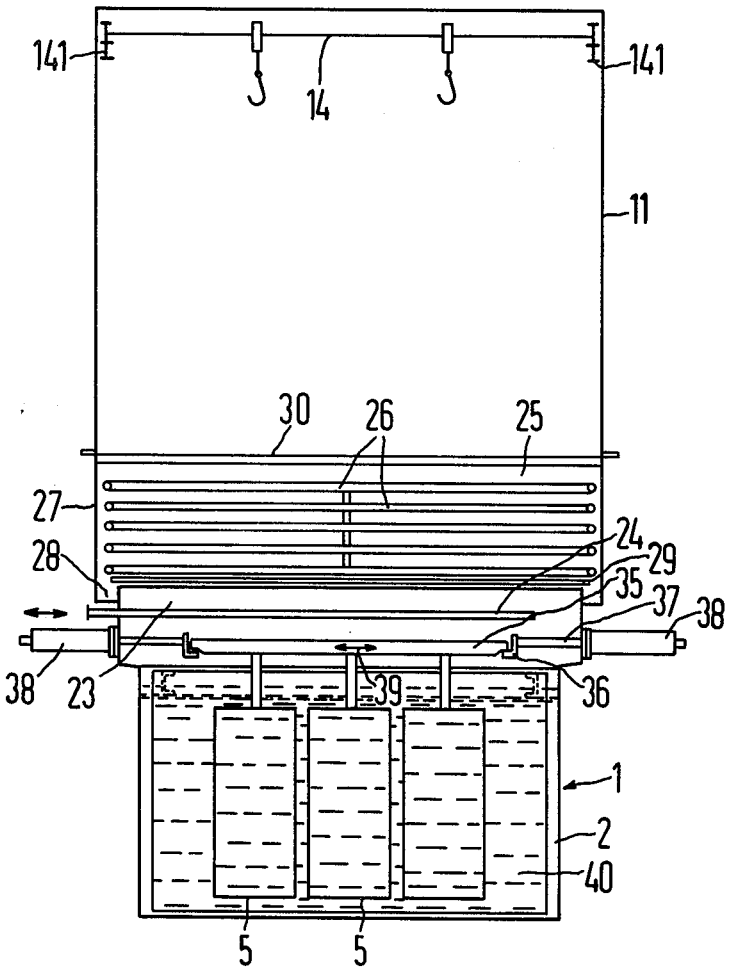
FIG. 2 is taken along II—II of FIG. 1.
Figure 3:
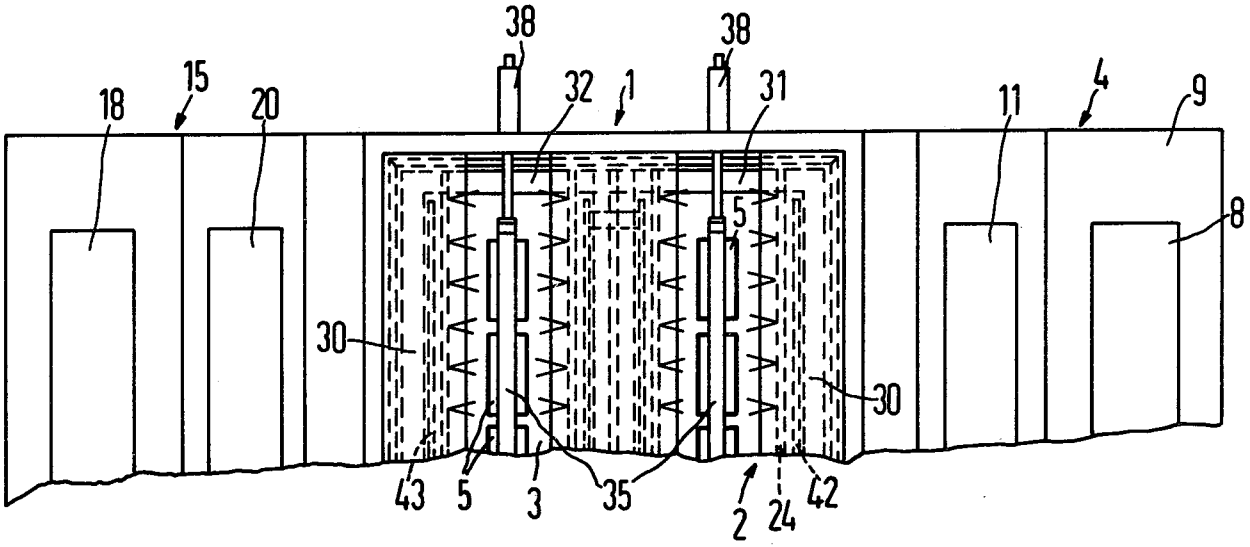
FIG. 3 is a partial plan view of plating tank of the FIG. 1 device.

FIGS. 1 through 3 show an assembly for the electrodeposit of aluminum onto substrate goods having a plating tank 1 formed by two individual cells 2 and 3, which are identically designed with a rectangular cross-section. The two individual cells 2 and 3 lie in series behind one another and can be selectively loaded with goods carriers 5 after they pass through a charging liquid lock 4. The charging lock is formed by a container 6 in which a fluid 7, for example toluol, compatible with the aluminum electrolyte is situated. An introduction shaft 8 which is closed at its upper end dips into said fluid. An inert gas is situated in the shaft, which contributes to the fact that only slight amounts of atmospheric oxygen and humidity advance to the lock fluid through this shaft.

The container 6 is tightly sealed at its upper end with a cover 9. A hood 10 is rigidly and sealably connected to the cover 9. The hood encloses an interior space containing inert gas and extends over a part of the charging lock 4 and completely over the two cells 2 and 3.

The cover 9 has an inlet portal 11 through which the goods carrier frames can be passed after having passed through the charging lock 4. As indicated by arrows in FIG. 1, the goods carriers 5 are introduced into the container 6 of the charging lock 4 through the introduction shaft 8 and are brought from the outlet end of the introduction shaft 8 to a position under the inlet portal 11 with the assistance of a truck 13 movable on rails 12 attached to the sidewalls of the container 6. The goods carriers 5 are removed from the truck 13 with the assistance of a movable hoist 14, conducted through the inlet portal 11, and conveyed by the hoist 14 within the hood 10 for deposit into the corresponding individual cell 2 or 3 for electro-plating. After the electro-plating, the goods carriers 5 are removed from the corresponding individual cell 2 or 3 by the hoist 14 and passed out of the hood 10 through a discharging lock 15, as indicated by arrows in FIG. 1. The hoist 14 is movable on a truck which rides on rails 141 attached to both sides of the cover hood.

Like the charging lock 4, the discharging lock 15 comprises a container 16 in which a corresponding fluid 17, for example toluol, compatible with the electrolyte is situated. A discharge shaft 18 proceeds through a corresponding opening in a cover 19 covering the container 16, whereby the lower inlet end of the discharge shaft 18 dips below the level of the fluid 17. The container 16 is connected through an outlet portal 20 to the cover hood 10 through which the goods carriers 5 with the aluminum-plated goods can be delivered into the discharging lock and onto a truck 21 which is brought at this point under the portal 20 opening. The truck 21 runs on rails 22 laterally applied to the container 16. Like the introduction shaft 8, the discharge shaft 18 is closed at its upper end such that no atmospheric humidity and no atmospheric oxygen can penetrate.

As so far described, this type of device is the subject matter of the German OS No. 31 33 162. As already mentioned, aluminum-plating electrolytes react with water and air upon formation of solids. It has further been shown that an electro-plating temperature of approximately 100° C. must be employed for an economical deposition of the aluminum in order to achieve a correspondingly high deposition rate. This results in the fact that, due to the partial vapor pressures of the individual components, a considerable amount of solvent as well as some aluminum alkyl can collect under the closing hood 10. However, large amounts of solvent can also quickly evaporate when the goods carriers are removed so that even the aluminum complex solid per se can be entrained in finely distributed form, this then forming a fine smoke. Moreover, the aluminum alkyl evaporating into the gas chamber reacts with traces of atmospheric oxygen and humidity forming smoke.

To prevent this smoke formation, the goods carriers 5 removed from the individual cells 2 and 3 after the electroplating process are inventively conducted through a liquid spray zone 23 whereby they are sprayed off with liquid streams from spray pipes 24. The spray pipes 24 are disposed in pairs in order to be able to spray the goods carriers 5 at opposed sides. The solvent condensate which can be produced relatively easily from the aluminum-plating electrolyte may be expediently employed for spraying, or the electrolyte may be used as the source for spray agent. The aluminum-plating electrolyte which may still be potentially adhering is thus rinsed off.

The spray zone 23 is followed by a condensing zone 25 in which both the solvent and the aluminum alkyl are condensed. This condensing zone is formed by cooling coils 26 lying above one another which are surrounded by a condensation plate 27. The cooling coils 26 and the condensation plate 27 are disposed immediately above the spray zone 23 and laterally outward of the spray chamber 23 such that a type of condensation channel 28 is formed to collect the condensate dripping off of the cooling coils 26. This condensate can be pumped from the channel 28 for re-employment in spraying the goods and the goods carriers. A central condensate channel 29 which, as FIG. 2 shows, discharges into the condensation channel 28 is provided in the area of the cooling coils 26 lying between the individual cells 2 and 3.

The condensing zone 25 is covered by a cover plate 30 having two slot openings 31 and 32 just suitable for the passage of the goods carriers therethrough from and back into the interior space of the hood 10.

As a result of this system comprising the spray zone 23 and condensing zone 25 and of the slotted cover plate 30 smoke is reliably prevented from forming within the cover hood 10 and the fluid locks of the charging and discharging locks 4 and 15 are prevented from becoming contaminated.

After the passage of the goods carriers 5 the inlet portal 11 and the outlet portal 20 each can be closed with the assistance of covers 110 and 200 respectively, which can be operated from the outside. In the event of temperature gradients in the device this closing for example may be necessary to avoid the passage of worth mentioning amounts of toluol from the plating tank 1 or the spray chamber 23 to the charging lock 4 or the discharging lock 15 and vice versa.

As can particularly be seen from FIG. 1, coolant is supplied over an intake nozzle 33 and is in turn withdrawn over a discharge nozzle 34. The coolant feed can ensue in a closed circulation whereby a cooling means, such as of conventional type, must be provided for cooling the coolant.

The individual goods carriers 5 are secured to a transport rod 35, as can be seen in greater detail in FIG. 2. A corresponding end noses, this rod rests on angular carriers 36 which consist of highly conductive material since the goods carriers are contacted to the negative pole of the voltage source over them in a manner known per se. The angular carriers 36 are secured to the end of piston rods 37 which can be moved over guide cylinders 38 in the direction of arrow 39 in order to move the goods carriers 5 suspended at the transport rod 35 into the individual cells 2 and 3 filled with aluminum-plating electrolyte 40.

As FIG. 1 shows, the vats of the individual cells 2 and 3 in the sample embodiment are connected to one another over a bridge 41 so that the same electrolyte level derives in the vats of the individual cells 2 and 3.

Anode plates 42 and 43 which are contacted in a manner known per se are secured to the vat walls of the individual cells 2 and 3 in a standard manner.

Although various minor modifications may be suggested by those versed in the art, it should be understood that we wish to embody within the scope of the patent warranted hereon all such modifications as reasonably and properly come within the scope of our contribution to the art.

I claim as my invention:

1. In an assembly for the electro-deposit of aluminum onto core goods having a plating tank including at least one open-ended cell containing aprotic, oxygen-free and water-free, organic aluminum electrolyte, a hood means, having inlet and outlet portals, defining an interior space over said at least one cell open end closed to ambient and containing an inert gas, and truck means movable in said interior space for sequentially drawing goods carriers through said inlet portal, passing said goods carriers into and out of said at least one cell, and discharging said goods carriers through said outlet portal, a charging liquid lock means connected to said inlet portal for inputing goods carriers to said plating tank, a discharging liquid lock means connected to said outlet portal for removal of goods carriers from said plating tank, apparatus for preventing smoke formation in said interior space and contamination of said charging and discharging liquid lock means comprising a spray chamber immediately over said at least one cell open end having pipe means for directing liquid sprays at opposed sides of said goods carriers, a condensing chamber immediately over said spray chamber having means for cooling the interior thereof, and a cover plate defining a slot correspondingly aligned with the open end of said at least one cell for passage of said goods carriers between said interior space of said hood means and said at least one cell.

2. The apparatus of claim 1, further comprising a plurality of identical said cells disposed parallel and behind one another, each said cell being respectively associated with a further said spray chamber, condensing chamber and cover plate slot.

3. The apparatus of claim 1, wherein said sprays are directed at said goods carriers perpendicularly to the direction of movement thereof between said hood means interior space and said at least one cell.

4. The apparatus of claim 1, wherein said means for cooling comprises cooling coils extending about the path of movement of said goods carriers.

5. The apparatus of claim 4, further comprising channels beneath said cooling coils for collecting condensate.

6. The apparatus of claim 5, further comprising means for conducting said condensate to said pipe means.

* * * * *